US010220248B1

(12) United States Patent
Bellerive et al.

(10) Patent No.: US 10,220,248 B1
(45) Date of Patent: Mar. 5, 2019

(54) SPA ROWING ADAPTER

(71) Applicant: Super Swim Corp., Ft. Myers, FL (US)

(72) Inventors: Donald Bellerive, Ft. Myers, FL (US); David Bellerive, Ft. Myers, FL (US)

(73) Assignee: Super Swim Corp., Ft. Myers, FL (US)

( * ) Notice: Subject to any disclaimer, the term of this patent is extended or adjusted under 35 U.S.C. 154(b) by 0 days.

(21) Appl. No.: 16/043,211

(22) Filed: Jul. 24, 2018

(51) Int. Cl.

| | |
|---|---|
| ***A63B 22/00*** | (2006.01) |
| ***A63B 21/008*** | (2006.01) |
| ***A63B 69/08*** | (2006.01) |
| *A63B 69/06* | (2006.01) |

(52) U.S. Cl.
CPC ..... *A63B 22/0076* (2013.01); *A63B 21/0083* (2013.01); *A63B 69/08* (2013.01); *A63B 21/008* (2013.01); *A63B 69/06* (2013.01); *A63B 2022/0082* (2013.01); *A63B 2022/0084* (2013.01); *A63B 2069/064* (2013.01); *A63B 2069/066* (2013.01); *A63B 2208/03* (2013.01)

(58) Field of Classification Search
CPC ..... A63B 21/008; A63B 21/0083; A63B 21/0084; A63B 21/00845; A63B 21/0085; A63B 21/0087; A63B 21/0088; A63B 21/0089; A63B 2022/0082; A63B 2022/0084; A63B 69/06; A63B 69/08; A63B 2069/062; A63B 2069/064; A63B 2069/066; A63B 2069/068
See application file for complete search history.

(56) References Cited

U.S. PATENT DOCUMENTS

| | | | | |
|---|---|---|---|---|
| 2,586,024 | A * | 2/1952 | Glasgow | A63B 69/08 297/344.1 |
| 4,903,961 | A * | 2/1990 | Solymosi | A63B 69/08 4/497 |
| 5,306,219 | A * | 4/1994 | Solymosi | A63B 69/08 482/111 |
| 5,562,576 | A * | 10/1996 | Mangine | A63B 69/08 482/72 |
| 7,597,652 | B2 | 10/2009 | Walker | |
| 2003/0100411 | A1* | 5/2003 | Walker | A63B 21/0084 482/55 |
| 2003/0153437 | A1* | 8/2003 | Tseng | A63B 21/0083 482/73 |
| 2008/0280736 | A1* | 11/2008 | D'Eredita | A63B 21/154 482/72 |
| 2013/0203566 | A1* | 8/2013 | Finestein | A63B 21/012 482/114 |

* cited by examiner

*Primary Examiner* — Joshua Lee
(74) *Attorney, Agent, or Firm* — Larson & Larson, P.A.; Justin P. Miller; Frank Liebenow

(57) ABSTRACT

The spa rowing adapter is a device for installation within an existing pool or spa that transforms the pool or spa into a rowing machine. The user grips lever arms, pulling on the arms from a seated or standing position in a rowing motion. In contrast to the prior art, the spa rowing adapter uses a resistance cylinder rather than floppy resistance bands or bungee cords. The resistance cylinder provides an adjustable amount of resistance during both the extending and retracting motions. The resistance cylinder changes length in response to a force, with the resistance of the motion set by an internal mechanism. The internal mechanism is adjustable by the user through rotation of a collar.

18 Claims, 6 Drawing Sheets

SPA ROWING ADAPTER

FIELD

This invention relates to the field of exercise equipment and more particularly to a collection of equipment that creates a rowing machine inside a pool or spa.

BACKGROUND

Spas and pools are used in homes, hospitals, hotels, and business for personal relaxation, exercise, and therapy. A spa, or pool, is an investment. Any device that can expand its scope of use makes for a greater return on the investment, while allowing for more activities without requiring more space.

Rowing is often cited as an excellent full-body, but low-impact, form of exercise. But rowing requires a dedicated machine, thereby increasing cost and space requirements.

What is needed is a device that can be installed in an existing spa or pool, allowing it to be used as a rowing machine.

SUMMARY

The spa rowing adapter is a device for installation within an existing pool or spa, transforming the pool into a rowing machine. The term spa, as used within this application, will refer to any device that can hold water and an individual, such as a pool, hot tub, and such related devices. The device terms are used interchangeably in this application. The user grips lever arms, pulling on the arms from a seated, squatting, or standing position in a rowing motion.

The lever arms are formed from one or more tubes. One end of the tube includes a grip or handle, the other end connects to an anchor in or near the pool deck.

The tube is preferably two or more nested tubes, thus allowing adjustment of arm length.

In contrast to the prior art, the spa rowing adapter uses a resistance cylinder rather than floppy resistance bands or bungee cords. The resistance cylinder provides an adjustable amount of resistance during both the extending and retracting motions. The resistance cylinder changes length in response to a force, with the resistance of the motion set by an internal mechanism. The internal mechanism is adjustable by the user through rotation of a collar.

In the preferred embodiment, the resistance cylinder creates a force that opposes any attempt to increase its length. But the resistance cylinder does not oppose a reduction in length. Thus, the pulling motion of the user is opposed, but the motion to return the lever arms to their original position is not opposed.

The resistance cylinder has two primary connections. The first connection is between the cylinder and the pool deck, coping, or other surface surrounding the pool. The second connection is between the cylinder and the lever arm.

The point of connection between the resistance cylinder and the lever arm is adjustable using a releasable clamp. This adjustability permits the user to adjust the stroke of the lever arm, as well as providing a secondary resistance adjustment by affecting the length of the lever arm.

The lever arms and resistance cylinder pivot about points on the pool deck that are above the water level, lengthening the life of the equipment by minimizing contact with the pool water.

To understand the motion of the lever arm and resistance cylinder during use, a discussion of degrees of freedom is helpful.

The connections between the pool deck and resistance cylinder, and pool deck and lever arm, each with two degrees of freedom ("DOF"). The first DOF is rotation of the arm and resistance cylinder. This can be thought of as the motion of the lever arm and resistance cylinder during the pull-back portion of a row. The second DOF is an upward/downward rotation toward and away from the surface of the water. This can be thought of as a change in height of the grips as the user rows.

The connection between the cylinder and lever arm has only one degree of freedom—a rotation of the resistance cylinder with respect to the lever arm. Limiting this joint to a single degree of freedom avoids the inconsistent resistance that would result from angle between the resistance cylinder and lever arm changing during a stroke.

The lever arms are adjustable and removable. The adjustability is a result of a telescoping arm. A smaller tube slides inside a larger tube, locked in place by a collar. The user can slide the smaller tube in or out to choose the desired arm length, then fix the length using the collar.

The lever arms and resistance cylinder are removable because each affixes to the pool deck using pivots that fit within pivot anchors. The pivot anchors are installed into penetrations. The pivots slide in and out of the anchors, and rotate within the pivot anchors during use.

Thus, the spa rowing adapter can be installed in a pool for use, then readily removed when it is no longer needed.

The resistance cylinders are preferably adjustable in resistance. The resistance cylinder preferably operates using a contained quantity of oil. As the cylinder changes length, the oil is pushed from one portion of the cylinder through one or more holes or bores. By adjusting the size of the holes, or otherwise affecting the ability of the oil to flow, the resistance of the cylinder is adjusted.

The resistance is preferably adjusted using a circumferential collar. Such a collar allows a user to quickly adjust resistance by rotation of the collar, preferably with indexed positions indicating specific levels of resistance.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
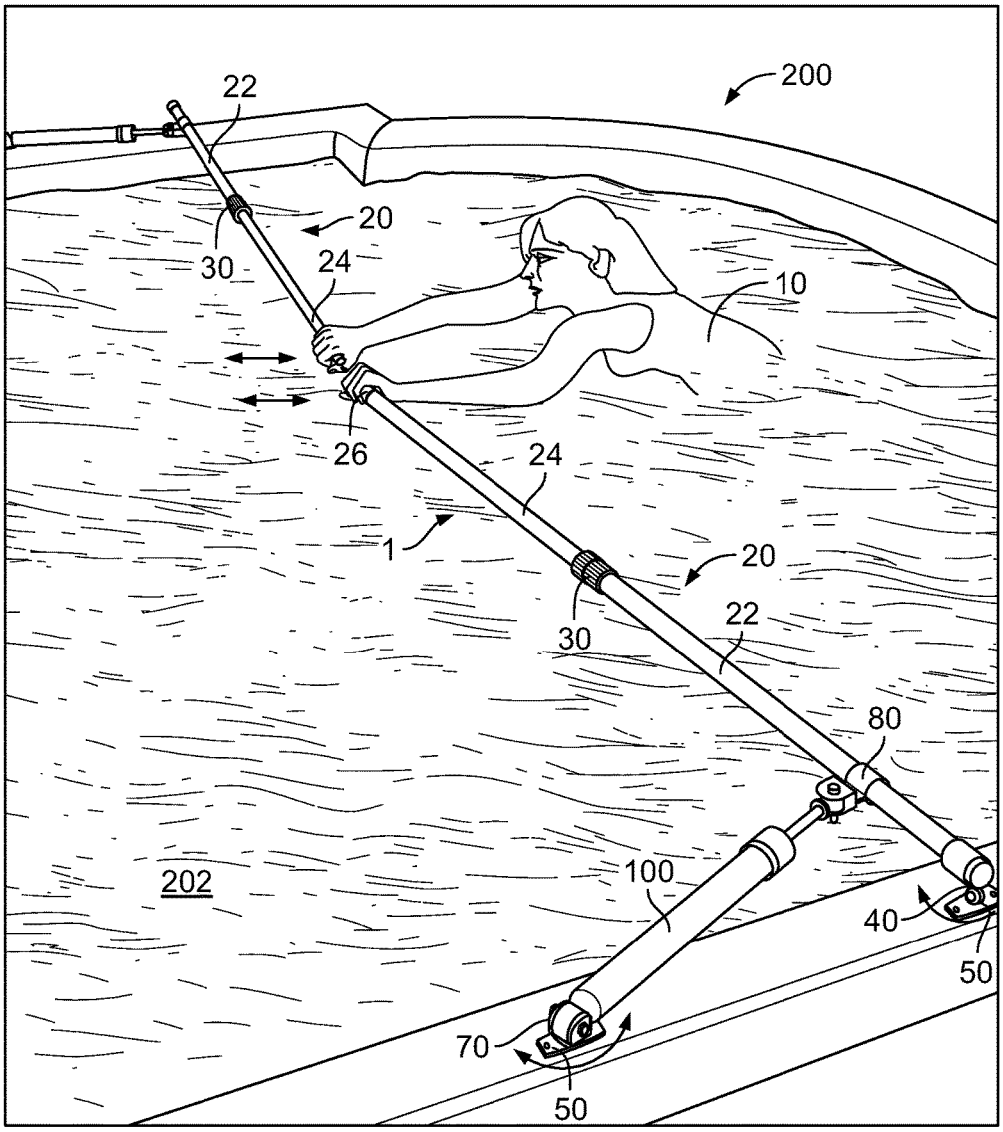
FIG. 1 illustrates a view of the spa rowing adapter in use within a pool.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a view of the spa rowing adapter in use within a pool is shown.

The spa rowing adapter 1 is shown installed within a pool 200, being operated by a user 10, the user 10 partially submerged in the water 202.

The user 10 holds the grips 26 to pull back on the lever arms 20. Motion of each lever arm 20 is resisted by a resistance cylinder 100, which interfaces with the lever arms 20 at a clamping collar 80.

Each lever arm 20 is preferably formed from a fixed outer section 22 and a telescoping inner section 24, which are held in relative position by a locking collar 30.

The arrows shown near the grips 26 depict the motion created by the user 10 during a rowing stroke, during which the lever arms 20 are moved back and forth.

The arrows around the primary pivot 40 and secondary pivot 70 depict the rotational motion that will occur as the user 10 moves the lever arms 20 back and forth during a stroke.

Figure 2:
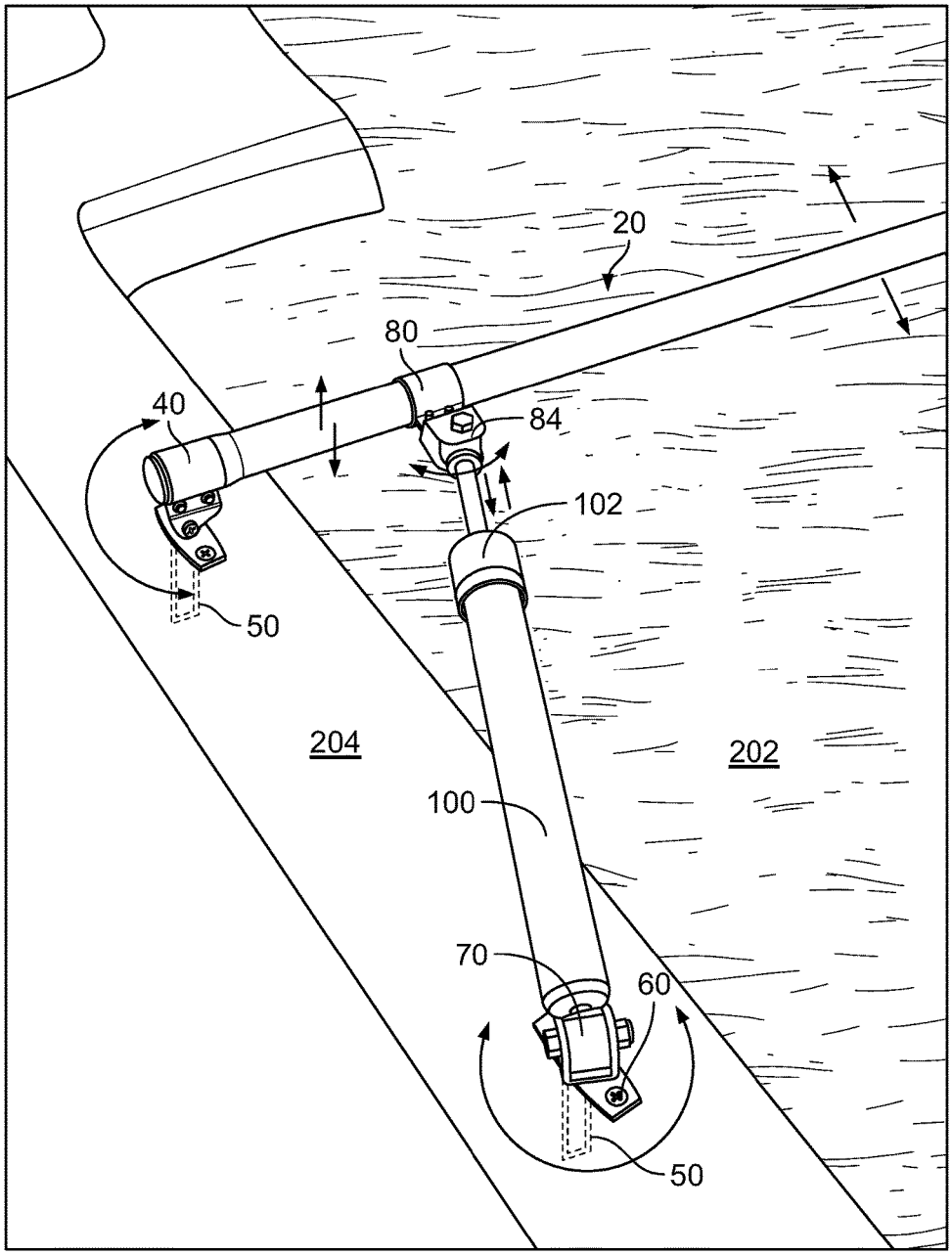
FIG. 2 illustrates a close-up view of the pivoting connections of the spa rowing adapter.

Referring to FIG. 2, a close-up view of the pivoting connections of the spa rowing adapter 1 is shown.

Each lever arm 20 rotates about a primary pivot 40. The primary pivot 40 rotates within a pivot anchor 50, which is installed through a pool deck 204. The primary pivot 40 permits rotation in the plane of the pool deck 204, as well as up and down.

Each resistance cylinder 100 rotates about a secondary pivot 70. The secondary pivot 70 rotates within a pivot anchor 50, which is installed through a pool deck 204. The secondary pivot 70 permits rotation in the plane of the pool deck 204, as well as up and down.

As shown, the primary pivot 40 and secondary pivot 70 are above the level of the water 202, rather than within the water 202. Keeping the lever arms 20 above the water 202 prevents the water 202 from being a source of resistance, which would affect the user's 10 ability to accurately and consistently set the resistance of the motion.

Each lever arm 20 and resistance cylinder 100 connect at a clamping collar 80 with each associated clamping collar pivot 84. The clamping collar pivot 84 permits rotation only in the plane formed by the lever arm 20 and resistance cylinder 100. Thus, from the perspective of the lever arm 20, the resistance cylinder 100 only moves toward and away from the user 10, but never rotating.

Figure 3:
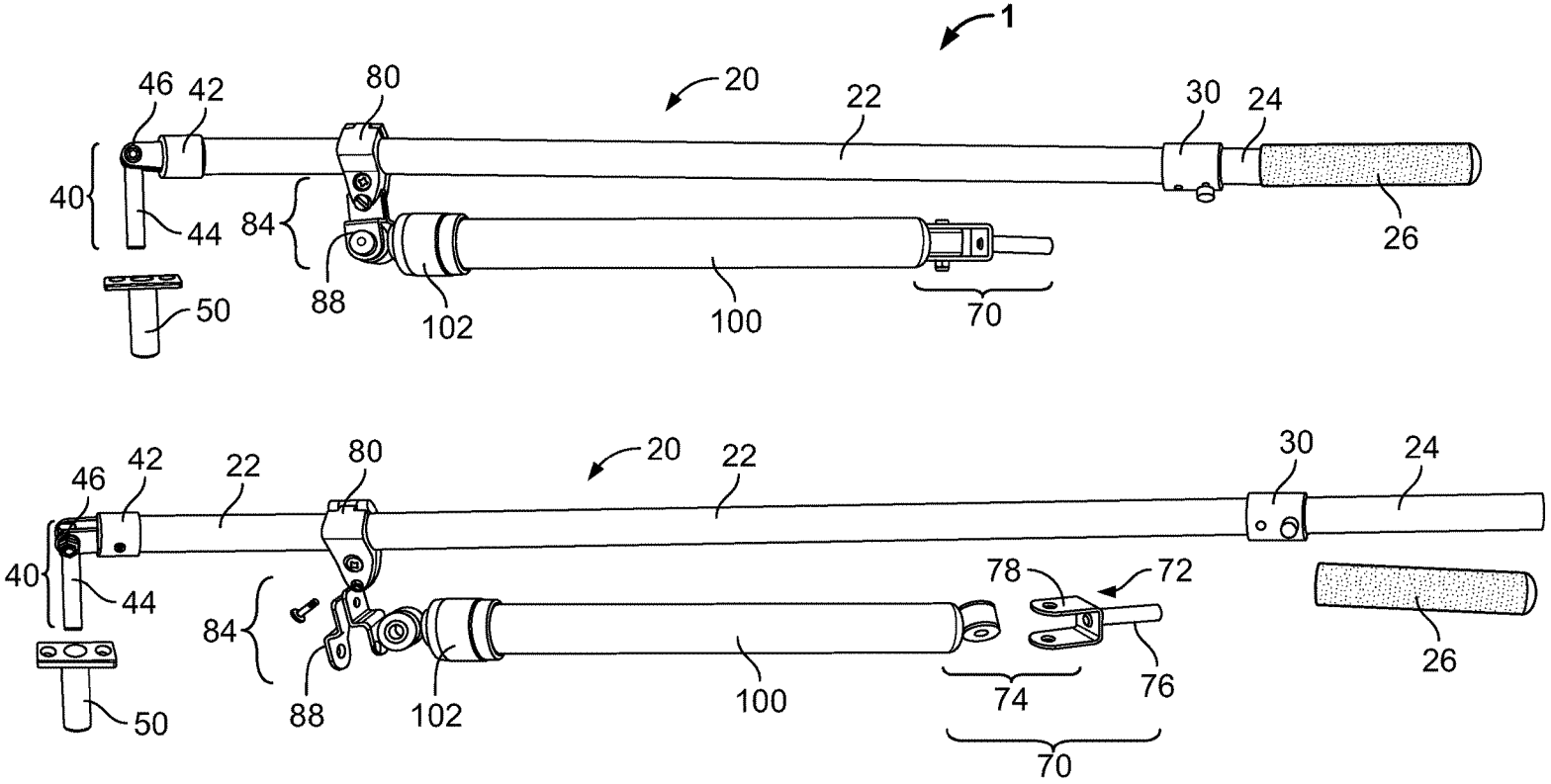
FIG. 3 illustrates the parts that form the spa rowing adapter.

Referring to FIG. 3, the parts that form the spa rowing adapter 1 are shown.

The lever arm 20 preferably includes a fixed outer section 22 and telescoping inner section 24. The telescoping inner section 24 includes an optional grip 26 formed of a softer material, such as rubber.

The locking collar 30 joins the fixed outer section 22 and telescoping inner section 24. Operating of the locking collar 30 is discussed further in conjunction with FIG. 5.

The primary pivot 40 connects the lever arm 20 to a pool deck 204 (see FIG. 2). A primary pivot collar 42 forms a connection to the lever arm 20. The primary pivot pin 44 rotates within a pivot anchor 50. The primary pivot hinge 46 joins the primary pivot collar 42 and primary pivot pin 44.

The secondary pivot 70 connects the resistance cylinder 100 to the pool deck 204 (see FIG. 2). The secondary pivot bracket 72 includes a secondary pivot yoke 78 and secondary pivot bracket projection 76. The secondary pivot yoke surrounds an end of the resistance cylinder 100, forming the secondary pivot hinge 74.

Each lever arm 20 interfaces with a resistance cylinder 100 at the clamping collar 80. The resistance cylinder 100 connects to the cylinder bracket 88, which in combination with the clamping collar 80, forms the clamping collar pivot 84.

Figure 4:
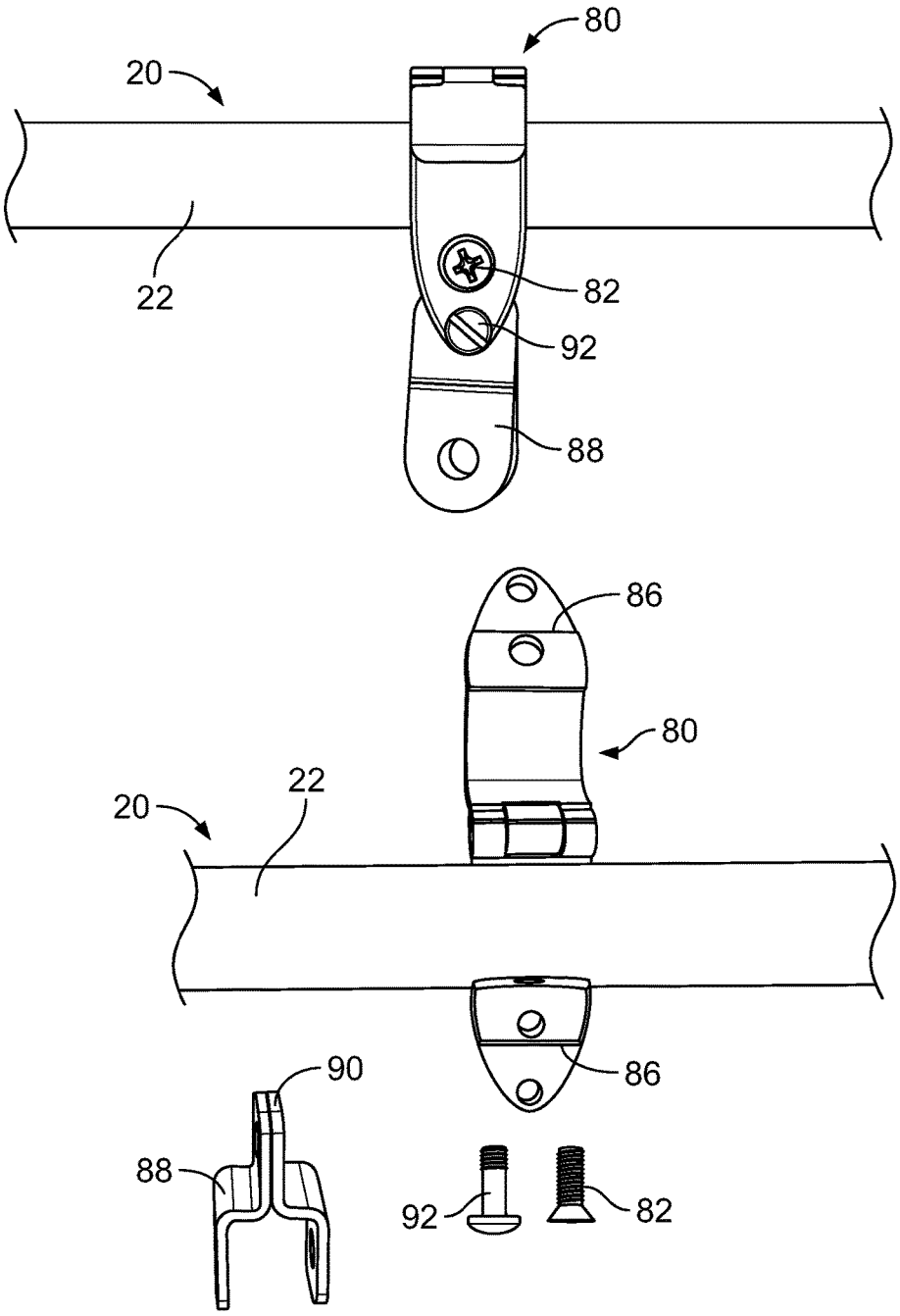
FIG. 4 illustrates the clamping parts used to affix the resistance cylinder to the lever arm.

Referring to FIG. 4, the clamping parts used to affix the resistance cylinder 100 to the lever arm 20 are shown.

It its closed position, the clamping collar 80 surrounds a section of the lever arm 20, which in the preferred embodiment is the fixed outer section 22. A clamping collar fastener 82 holds the clamping collar 80 closed around the cylinder bracket 88.

The cylinder bracket 88 connects to the clamping collar 80 at the clamping collar pivot 84 (see FIG. 2). Any relative rotation between the cylinder bracket 88 and clamping collar 80 may make the motion of the lever arm 20 feel loose. To prevent such relative rotation, a clamping collar bracing face 86 of the clamping collar 80 matches to a cylinder bracket bracing face 90. Each has a flat face, thus minimizing rotation.

The cylinder bracket fastener 92 holds the cylinder bracket 88 within the clamping collar 80.

Alternatively, the cylinder bracket 88 and clamping collar 80 are constructed as a single piece, thus avoiding the issue of relative rotation.

Figure 5:
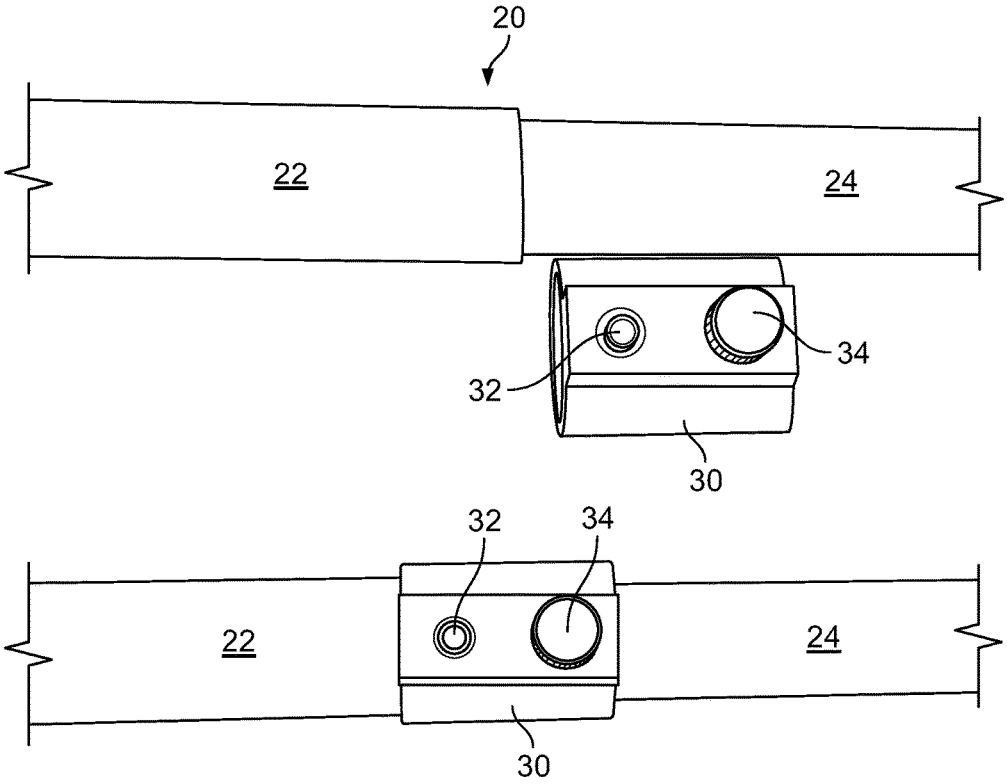
FIG. 5 illustrates the clamp used to fix the telescoping length of the lever arm.

Referring to FIG. 5, the clamp used to fix the telescoping length of the lever arm 20 is shown.

A locking collar 30 is placed at the overlap between the fixed outer section 22 and the telescoping inner section 24 of the lever arm 20. The locking collar 30 includes a set screw 32, such as a hex-keyed set screw.

A thumb screw 34, or screw with a knurled head, arms, spade-head, or wing-head, allows the user 10 (see FIG. 1) to adjust the length of the lever arm 20 without requiring tools. To do so, the user 10 (see FIG. 1) unscrews the thumb screw 34, thereby releasing the tension on the telescoping inner section 24. The telescoping inner section 24 is then moved to the desired length, and then tension is replaced by tightening the thumb screw 34.

Figure 6:
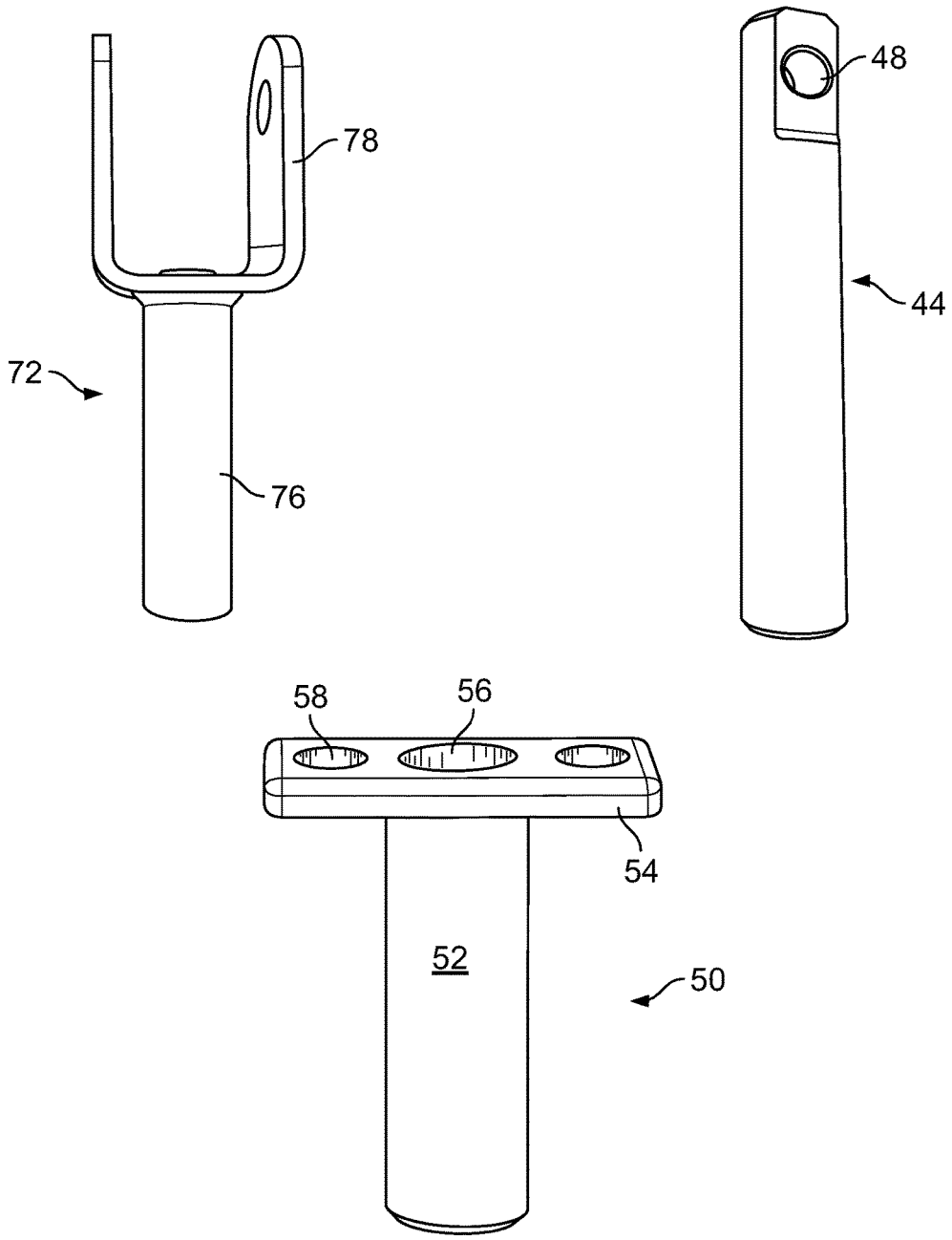
FIG. 6 illustrates the pivoting parts used to permit rotation of the lever arm and resistance cylinder.

Referring to FIG. 6, the pivoting parts used to permit rotation of the lever arm 20 (see FIG. 1) and resistance cylinder 100 (see FIG. 2) are shown.

Intended to interface with the resistance cylinder 100 (see FIG. 2), the secondary pivot bracket 72 includes a secondary pivot bracket projection 76 that fits, and rotates, within a pivot anchor 50 (see FIG. 2). The upper half of the secondary pivot bracket 72 is the secondary pivot yoke 78, which surrounds an end of the resistance cylinder 100 (see FIG. 3).

Intended to interface with the lever arms 20 (see FIG. 3), the primary pivot pin 44 fits, and rotates, within a pivot anchor 50 (see FIG. 3). The primary pivot pin penetration 48 forms one half of the primary pivot hinge 46 (see FIG. 3), the other half formed by the primary pivot collar 42 (see FIG. 3).

The pivot anchor 50 includes an anchor sleeve 52 that protrudes downward from an anchor plate 54. An anchor penetration 56 permits either the primary pivot pin 44 or secondary pivot bracket projection 76 to slide into the anchor sleeve 52, inside of which a pin may rotate.

One or more anchor fastener penetrations 58 permit the use of anchor fasteners 60 (see FIG. 2) that hold the pivot anchor 50 to the pool deck 204.

Equivalent elements can be substituted for the ones set forth above such that they perform in substantially the same manner in substantially the same way for achieving substantially the same results.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A spa rowing adapter that converts a pool into a rowing machine, the spa rowing adapter attaching to a pool wall, the spa rowing adapter using a resistance cylinder and not elastic bands or bungee cords, the spa rowing adapter comprising:

a lever arm with a first arm end and a second arm end;

the first end affixed at a pivot to the pool wall;

the second end adapted to be gripped by a user;

a resistance cylinder with a first cylinder end and a second cylinder end;

the first cylinder end affixed at a pivot to the pool wall;

the second cylinder end affixed at a clamping collar to the lever arm;

the resistance cylinder able to extend and retract in length;

the resistance cylinder creating a force in opposition to an extension in length; and whereby motion of the lever arm causes the resistance cylinder to extend and retract in length, creating resistance and thus permitting the user to exercise.

2. The spa rowing adapter of claim 1, wherein the lever arm is formed from a fixed outer section and a telescoping inner section;

thereby permitting adjustment of length by moving the telescoping inner section in and out of the fixed outer section.

3. The spa rowing adapter of claim 2, wherein the telescoping inner section is held in place with respect to the fixed outer section by a locking collar, the locking collar including a set screw and a thumb screw;

the thumb screw adjustable without tools, thereby permitting easy adjustment of length.

4. The spa rowing adapter of claim 1, further comprising:

one or more pivot anchors;

the one or more pivot anchors for installation into the pool wall;

the pivot anchors receiving the pivot of the lever arm, and the pivot of the resistance cylinder;

the pivot anchors allowing the pivot of the lever arm, and the pivot of the resistance cylinder to readily rotate, but also be removable without the use of tools.

5. The spa rowing adapter of claim 1, wherein the force created by the resistance cylinder is adjustable without replacement of the resistance cylinder.

6. The spa rowing adapter of claim 1, wherein the resistance cylinder uses an internal hydraulic fluid in order to create the force that opposes an increase in length.

7. A spa rowing adapter that permits adjustment of the resistance without requiring any replacement of parts, the spa rowing adapter for installation of a spa that has a water level, the spa rowing adapter comprising:

a lever arm that rotates about a first pivot, the first pivot affixed to the spa above the water level;

an adjustable resistance cylinder that rotates about a second pivot, the second pivot affixed to the spa above the water level;

the adjustable resistance cylinder affixed to the lever arm;

the motion of the lever arm altering the length of the adjustable resistance cylinder;

the adjustable resistance cylinder generating a force in opposition to the motion of the lever arm;

the force being adjustable;

whereby the lever arm is adapted for movement by a user, the user moving the lever arm in a rowing motion and thus exercising within a pool.

8. The spa rowing adapter of claim 7, wherein the lever arm is formed from a fixed outer section and a telescoping inner section;

thereby permitting adjustment of length by moving the telescoping inner section in and out of the fixed outer section.

9. The spa rowing adapter of claim 8, wherein the telescoping inner section is held in place with respect to the fixed outer section by a locking collar, the locking collar including a set screw and a thumb screw;

the thumb screw adjustable without tools, thereby permitting easy adjustment of length.

10. The spa rowing adapter of claim 7, further comprising:

one or more pivot anchors;

the one or more pivot anchors for installation into the pool wall;

the pivot anchors receiving the first pivot and the second pivot;

the pivot anchors allowing the first pivot and the second pivot to readily rotate, but also be removable without the use of tools.

11. The spa rowing adapter of claim 7, wherein the force created by the adjustable resistance cylinder is adjustable without replacement of the resistance cylinder.

12. The spa rowing adapter of claim 7, wherein the adjustable resistance cylinder uses an internal hydraulic fluid in order to create the force that opposes an increase in length.

13. A pool accessory that creates a rowing machine in association with a pool, the device for installation above a water level of the pool to avoid the resistance of the water during use, the pool accessory comprising:

a pair of lever arms in a pivoting relationship with the pool;

the lever arms, after installation, are substantially parallel to the water level;

a pair of resistance cylinders, each resistance cylinder of the pair of resistance cylinders in a rotating relationship with a lever arm of the pair of lever arms;

whereby motion of the lever arms causes a change in length of the resistance cylinders, thereby resisting the motion of the lever arms, and thus permitting exercise.

14. The pool accessory of claim 13, wherein the lever arm is formed from a fixed outer section and a telescoping inner section;

thereby permitting adjustment of length by moving the telescoping inner section in and out of the fixed outer section.

15. The pool accessory of claim 14, wherein the telescoping inner section is held in place with respect to the fixed outer section by a locking collar, the locking collar including a set screw and a thumb screw;

the thumb screw adjustable without tools, thereby permitting easy adjustment of length.

16. The pool accessory of claim 13, further comprising:

one or more pivot anchors;

the one or more pivot anchors for installation into the pool wall;

each lever arm of the pair of lever arms including a pivot that fits within one of the one or more pivot anchors;

each resistance cylinder of the pair of resistance cylinders including a pivot that fits within one of the one or more pivot anchors;

the pivot anchors allowing the lever arm the resistance cylinder to readily rotate, but to also be removable without the use of tools.

17. The pool accessory of claim 13, wherein the force created by the resistance cylinder is adjustable without replacement of the resistance cylinder.

18. The pool accessory of claim 13, wherein the resistance cylinder uses an internal hydraulic fluid in order to create the force that opposes an increase in length.

* * * * *